US010954629B2

(12) United States Patent
De Sousa Faria

(10) Patent No.: US 10,954,629 B2
(45) Date of Patent: Mar. 23, 2021

(54) HOISTING ROPE

(71) Applicant: LANKHORST EURONETE PORTUGAL, S.A., Maia (PT)

(72) Inventor: Rui Pedro De Sousa Faria, Sneek (NL)

(73) Assignee: Lankhorst Euronete Portugal, S.A., Maia (PT)

( * ) Notice: Subject to any disclaimer, the term of this patent is extended or adjusted under 35 U.S.C. 154(b) by 209 days.

(21) Appl. No.: 16/092,819

(22) PCT Filed: Apr. 11, 2017

(86) PCT No.: PCT/EP2017/058673
§ 371 (c)(1),
(2) Date: Oct. 11, 2018

(87) PCT Pub. No.: WO2017/178484
PCT Pub. Date: Oct. 19, 2017

(65) Prior Publication Data

US 2019/0301089 A1 Oct. 3, 2019

(30) Foreign Application Priority Data

Apr. 11, 2016 (NL) ..... 2016586

(51) Int. Cl.
*D07B 1/02* (2006.01)
*B66C 13/00* (2006.01)
(Continued)

(52) U.S. Cl.
CPC ..... *D07B 1/025* (2013.01); *B66C 13/00* (2013.01); *B66D 1/28* (2013.01); *D07B 1/145* (2013.01);
(Continued)

(58) Field of Classification Search
CPC ..... D07B 1/025; D07B 1/145; D07B 2201/1096; D07B 2201/2012;
(Continued)

(56) References Cited

U.S. PATENT DOCUMENTS 2,737,075 A * 3/1956 Poirier ..... D07B 1/02 87/6
3,078,755 A * 2/1963 Chace, Jr. ..... D04D 1/00 87/9
(Continued)

FOREIGN PATENT DOCUMENTS

DE 202010013519 U1 12/2010
EP 2028308 A2 2/2009
(Continued)

OTHER PUBLICATIONS

McKenna et al., "Handbook of Fibre Rope Technology, Introduction to Fibre Ropes; Rope Structures; Rope Production", Jan. 1, 2004, Woodhead Publishing Ltd, England, pp. 11-12, 81-95, 200-211 (29 pages).
(Continued)

*Primary Examiner* — Shaun R Hurley
(74) *Attorney, Agent, or Firm* — BakerHostetler

(57) ABSTRACT

The invention is directed to a synthetic hoisting rope comprising a solid core surrounded by a first braided layer of a first set of strands that is surrounded by a second braided layer of a second set of strands.

20 Claims, 4 Drawing Sheets

(51) Int. Cl.
*B66D 1/28* (2006.01)
*D07B 1/14* (2006.01)

(52) U.S. Cl.
CPC ..... *D07B 2201/1096* (2013.01); *D07B 2201/2012* (2013.01); *D07B 2201/2053* (2013.01); *D07B 2201/2096* (2013.01); *D07B 2501/2015* (2013.01); *D07B 2501/2038* (2013.01)

(58) Field of Classification Search
CPC .... D07B 2201/2015; D07B 2201/2053; B66C 13/00; B66D 1/28
See application file for complete search history.

(56) References Cited

U.S. PATENT DOCUMENTS 3,141,372 A * 7/1964 Benk ..... D07B 1/02 87/6
4,170,921 A * 10/1979 Repass ..... D04C 1/12 87/6
4,321,854 A * 3/1982 Foote ..... D07B 1/04 87/6
4,534,262 A * 8/1985 Swenson ..... D04C 1/12 57/210
4,640,179 A * 2/1987 Cameron ..... D04C 1/02 57/210
5,852,926 A * 12/1998 Breedlove ..... D02G 3/36 57/210
7,228,777 B2 * 6/2007 Morissette ..... D21G 9/0072 87/5
7,703,372 B1 * 4/2010 Shakespeare ..... A62B 1/16 87/6
8,136,438 B2 * 3/2012 Shakespeare ..... A62B 1/16 87/6
9,951,447 B2 * 4/2018 Hurlen ..... D07B 1/06
2005/0192581 A1 * 9/2005 Molz ..... D04C 1/12 606/74
2006/0179812 A1 * 8/2006 Clough ..... D04C 1/12 57/210
2009/0165637 A1 * 7/2009 Bosman ..... D07B 1/025 87/9
2010/0101833 A1 * 4/2010 Zachariades ..... D07B 1/147 174/136
2011/0189411 A1 8/2011 Elad et al.
2011/0197564 A1 * 8/2011 Zachariades ..... B32B 27/12 57/210
2012/0297746 A1 * 11/2012 Chou ..... D07B 1/02 57/230
2014/0090549 A1 * 4/2014 Hurlen ..... D04C 1/06 87/9
2014/0216782 A1 * 8/2014 Erlendsson ..... H01B 7/145 174/11 OR
2014/0260927 A1 * 9/2014 Gilmore ..... D04C 1/12 87/8
2014/0311323 A1 * 10/2014 Erlendsson ..... D07B 1/025 87/6
2015/0040746 A1 2/2015 Kirth et al.
2015/0113936 A1 * 4/2015 Amils ..... D07B 3/00 57/216
2015/0128792 A1 * 5/2015 Zachariades ..... D07B 1/04 87/6
2015/0247285 A1 * 9/2015 Amils ..... D07B 1/0686 57/221

FOREIGN PATENT DOCUMENTS

EP 2511406 A2 10/2012
WO WO 2004-020732 A2 3/2004
WO WO 2005-019525 A1 3/2005
WO WO 2011-015485 A1 2/2011

OTHER PUBLICATIONS

Samson Rope, "Samson K-100™ Inspection", YouTube, Apr. 5, 2016, p. 1, https://www.youtube.com/watch?v=yHrJQyWYM1g, accessed Sep. 21, 2016.

* cited by examiner

HOISTING ROPE

CROSS-REFERENCE TO RELATED APPLICATIONS

This application is the U.S. national stage of International Patent Application No. PCT/EP2017/058673 filed Apr. 11, 2017, which claims the benefit of NL Application Number 2016586, filed Apr. 11, 2016, the disclosures of both of which are incorporated herein by reference as if set forth in their entireties herein.

TECHNICAL FIELD

The invention is in the field of ropes. The invention is in particular directed to hoisting ropes for cranes.

BACKGROUND

Conventional hoisting ropes for cranes are steel wire ropes (SWRs). Although SWRs provide good mechanical properties, they are also associated with corrosion, (re) lubrication requirements, heavy weight and safety issues upon breaking of the wire. As improved alternatives to SWRs, synthetic hoisting ropes, i.e. hoisting ropes based on synthetic (polymer-based) fibers, have been proposed. Synthetic ropes are based on non-metallic materials such as polymer-based fibers and have shown favorable mechanical properties combined with typical low weights. However, providing synthetic hoisting ropes with similar mechanical and shape related characteristics as SWRs have proven to be challenging.

SUMMARY

Hoisting ropes are characterized by good axial load-elongation and load-bearing capacities, as well as radial performance. The axial load-bearing characteristics can be expressed as minimum breaking force, tensile strength, longitudinal modulus of elasticity, elongation-to-break and/or weight. The radial performance of hoisting ropes can also be expressed as lateral stiffness, lateral modulus of elasticity, bending performance and/or bending fatigue resistance.

The radial performance is of particular importance for hoisting ropes. Good radial performance leads to a minimal deformation of the circular cross-section of the rope during load-bearing operation. Deformation of the cross-section of the rope to a flat oval shape may complicate (aligned) winding or rolling of the rope onto a drum of the crane, cause derailing of the rope from sheaves and/or result in an increased wear of the rope.

SWRs have solid wires and generally show good bending performance, while general-purpose synthetic ropes generally show poor bending performance and can as such typically not be used as hoisting ropes.

WO2005/019525 describes a rope comprising a non-load-bearing core that is surrounded by a single braided layer. The core is disclosed as resisting crushing of the rope.

EP2511406 describes an attempt to improve the bending performance of synthetic ropes by providing an inner core in contact with surrounding braided fibers that are surrounded by twisted outer strands that each comprises an outer core and twisted fibers. A drawback of this rope is that each strand requires a core and surrounding fibers resulting in an unfavorable relative cross sectional area for the solid monofilament part and concomitantly a low strength to weight of the rope.

DETAILED DESCRIPTION

The present invention is directed to a synthetic hoisting rope comprising a solid core surrounded by a first braided layer of a first set of strands, wherein the first braided layer is surrounded by a second braided layer of a second set of strands.

Ropes are typically constructed by braiding and/or twisting strands of fibers. In additional, ropes may comprise one or more monofilaments of resins or composite materials. The inventors have found that by providing two braided layers around the solid core, a rope having a very high lateral stiffness is obtained.

Figure 1:
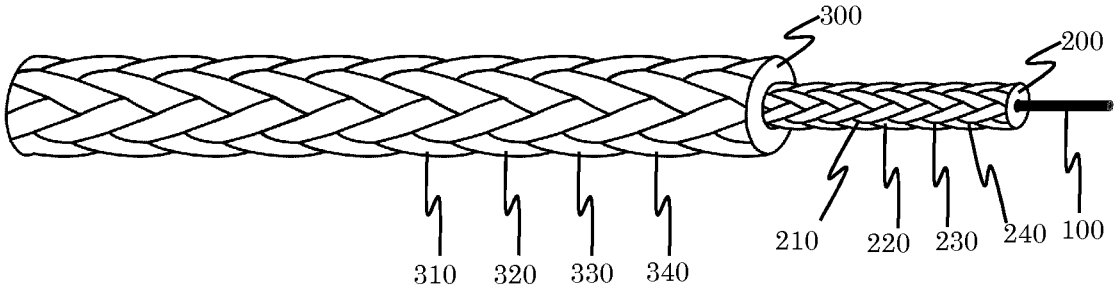
FIG. 1 illustrates a side perspective view of a rope, according to an aspect of this disclosure.

FIG. 1 shows a schematic representation of a particular embodiment of the present invention. The solid core (100) is surrounded by the first braided layer (200) that is surrounded by the second braided layer (300). The braided layers comprise sets of strands (210, 220, 230, 240, 310, 320, 330 and 340) that each comprise fibers (not shown).

Figure 2:
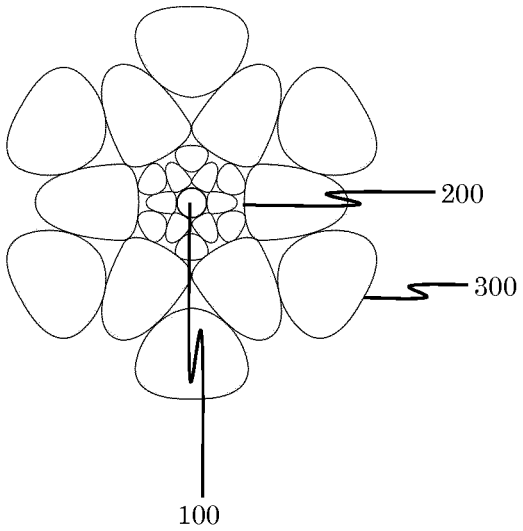
FIG. 2 illustrates an end view of the rope shown in FIG. 1.

FIG. 2 shows a schematic cross-section of a particular embodiment of the present invention. The solid core (100) is surrounded by the first braided layer (200) that is surrounded by the second braided layer (300). The braided layers comprise strands (drawn as solid shapes) that each comprise fibers (not shown).

Figure 3:
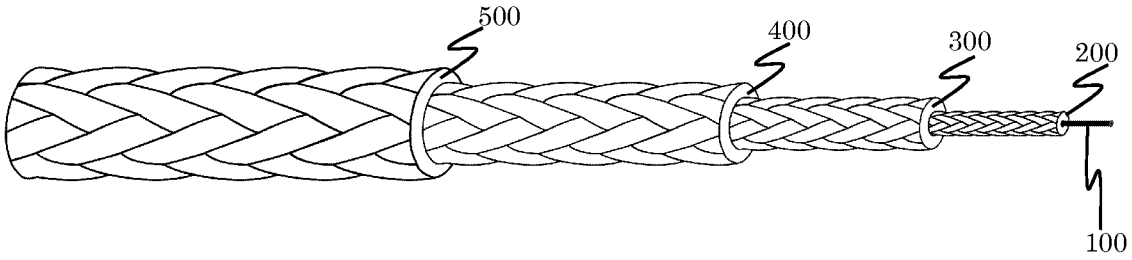
FIG. 3 illustrates a side perspective view of a rope, according to another aspect of this disclosure.

Additional braided layers may be present surrounding the second braided layer to add additional lateral stiffness. As such, the hoisting rope of the present invention comprises at least two, but may comprise a plurality of successive braided layers. FIG. 3 illustrates a particular embodiment of a rope comprising four successive braided layers (200, 300, 400 and 500).

The sets of strands preferably independently comprise high performance fibers. High performance fibers are known in the field. Examples of high performance fibers are fibers based on ultra-high molecular weight polyethylene (UHMWPE, e.g. available under the trade names Dyneema™ and Spectra™), (para-)aramids (e.g. available under the trade names Twaron™, Kevlar™ and Technora™), liquid crystal aromatic polyester (e.g. available under the trade name Vectran™), carbon-fibers and the like. For instance, the first set of strands may comprise Dyneema fibers while the second set may comprise Vectran™ fibers. Each set of strands may also comprise a mixture of different types of fibers.

The fibers may additionally comprise an overlay finish, as is for instance the case for Dyneema™ fibers comprising XBO which are available from DSM N.V., the Netherlands.

High performance fibers are known for their high tenacities and low stretch (elongation at break). Preferably, the first set and/or second set of strands comprise high performance fibers which preferably have a tenacity of at least 15 g/denier, more preferably at least 20 g/denier. The tenacities of commonly used fibers are known in the field; see for instance Handbook of Fibre Rope Technology by H. A. McKenna, J. W. S. Hearle and N. O'Hear, 2004, Woodhead Publishing Ltd. The high performance fibers are preferably also characterized by a low elongation at break (typically lower than 3.5%). This is another favorable property for application in hoisting ropes.

For ease of production, e.g. to limit the number of required production steps, it is preferred that the first and the second braided layer comprise, more preferably consist of the same composition. Additionally, it is preferred that the optionally present additional braided layers also comprise the same composition as the first and/or second braided layers. Most preferable, all braided layers comprise the same fibers. Preferably, all braided layers comprise UHMWPE available under the trade name Dyneema™.

The set of strands may, independently comprise 3 to 32 strands. For instance, the first set of strands may comprise 12 strands, while the second set of strands comprise 16 strands. Particularly good results have been obtained with each set of strands comprising 12 strands. Some deviation from this preferred number of strands may be allowable. For instance, each set of strands can independently comprise at least 6 and up to 24 strands.

Each layer of the rope comprises braided strands. As such, the layer is a braided layer. The braided layers are preferably each constructed by braiding strands. These strands are typically build from twisting one or more yarns left or right handed or may be braided or laid strands. The yarns are generally prepared from bundles of high performance fibers as described hereinabove.

The first and the second braided layers are each load-bearing layers. Load-bearing is a term used in the field to indicate that the layers contributes to the overall load-bearing capabilities of the rope. A non-load-bearing layer is for instance a jacket. Jackets are generally braided strands that serve to protect the rope from wear by abrasion. Such a jacket could additionally be added to the construction as described herein.

In a preferred embodiment, the second braided load-bearing layer has a load-bearing capacity of at least 60%, preferably at least 65%, more preferably at least 70% of the total load-bearing capacity of the rope.

The load-bearing capacity of each layer can empirically be determined as follows. If the rope is built in steps from the center layer to the last layer, at the end the production of each layer a rope structure is obtained which can be tested by any rope testing method (e.g as described in ISO 2307). If each layer (cumulative construction up to that layer) is tested individually, it becomes possible to establish the contribution of each layer. Alternatively, the load-bearing capacity can be estimated theoretically by the relation between linear densities of each layer, because it is (mainly) the quantity of fiber in each layer that provides the load bearing capacity.

To improve the abrasion resistance of the present rope, it may be coated with a protective coating. The protective coating preferably comprises comprising polyurethane, silicon or a combination thereof. Appropriate coatings are for instance coatings based on anionic polyurethane.

It was surprisingly found that coating the rope on a yarn level further improves the lateral stiffness and bending fatigue resistance of the rope. As such, it is preferred that the braided layers independently comprise yarns that comprise the protective coating. An even further preferred embodiment is the rope wherein the coating surrounds the yarns. Without wishing to be bound by theory, during bending of the rope (e.g. during winding or unwinding of the rope) the yarns may experience internal friction caused by movement of a yarn relative to its adjacent yarn. By coating each yarn (including the internally located yarns) present in a braided layer, the bending fatigue resistance and the lateral stiffness is improved. As such, in a particularly preferred embodiment, essentially all yarns present in the first, second and optionally additional braided layers are surrounded by the protective coating. The yarns typically comprise a multitude of fibers. In accordance with a preferred embodiment of the invention, one or more, preferably all fibers may be surrounded by the protective coating as well.

In the case that coating the rope is carried out at a rope level, viz. not at a yarn level as described above, the maximum level of coating is generally about 15 wt % based on the total weight of the rope. However, by coating on yarn level, much higher coating levels can be obtained, for instance up to 25 or 30 wt %. A higher level of coating results in better abrasion resistance and increased lateral stiffness. Therefore, the rope preferably comprises more than 20 wt %, more preferably more than 25 wt % coating based on the total weight of the rope.

A further advantage of coating the rope on a yarn level is that the rope temperature can be naturally maintained within operational boundaries during working conditions. Stress on the rope caused by bending and load-carrying of the rope thus does generally not lead to temperature exceeding dangerous levels. Preferably, the rope's temperature remains below 70° C., preferably below 55° C. for the double bend zone during "cyclic bending over sheave" (CBOS) testing.

Figure 4:
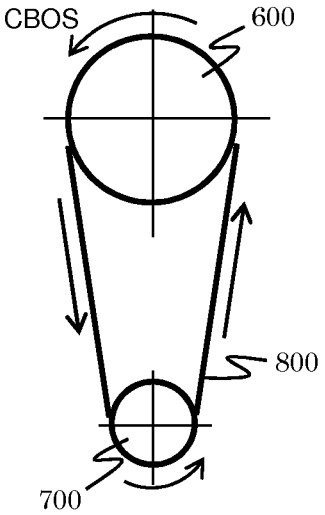
FIG. 4 illustrates a side view of a testing machine, according to an aspect of this disclosure.

CBOS testing is a known test in the field for testing the bending performance of hoisting ropes. CBOS testing mimics very demanding working conditions. The CBOS testing as described herein is carried out on a machine comprising two sheaves (600, 700) on which the rope (800) is positioned and rotated as illustrated in FIG. 4. During CBOS testing, the rope is cycled back and forward while bending over a sheave, at a set frequency and tension. It is always the same rope section that is bended, which accelerates the bending fatigue mechanism. In a CBOS testing with parameters as indicated below in table 1, the rope preferably has at least 10000 rope bending cycles to failure (CTF).

Figure 5:
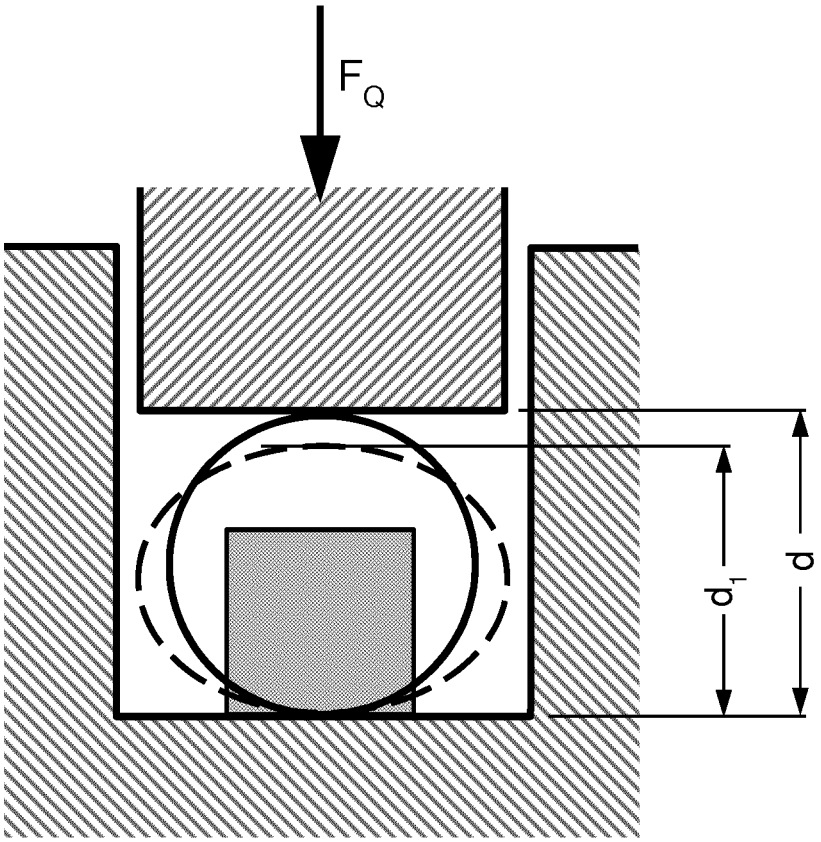
FIG. 5 illustrates a side view of a rope with a force applied, according to an aspect of this disclosure.

The lateral stiffness (also referred to a lateral modulus of elasticity or $E_{SQ}$-modulus) of a rope is generally determined by applying a longitudinal force and a lateral force ($F_Q$) on the rope such that the rope deforms in the lateral direction of the rope (diameter d vis-à-vis dl), as illustrated in FIG. 5. The resistance to deformation of the rope in the lateral direction under these conditions is the lateral stiffness. The lateral stiffness of the rope is preferably at least 500 N/mm$^2$.

The rope according to the present invention having a diameter of 20 mm typically has a minimum breaking force (MBF) of at least 10, preferably at least 20, more preferably at least 30 metric ton-force as determined by ISO 2307.

Figure 6:
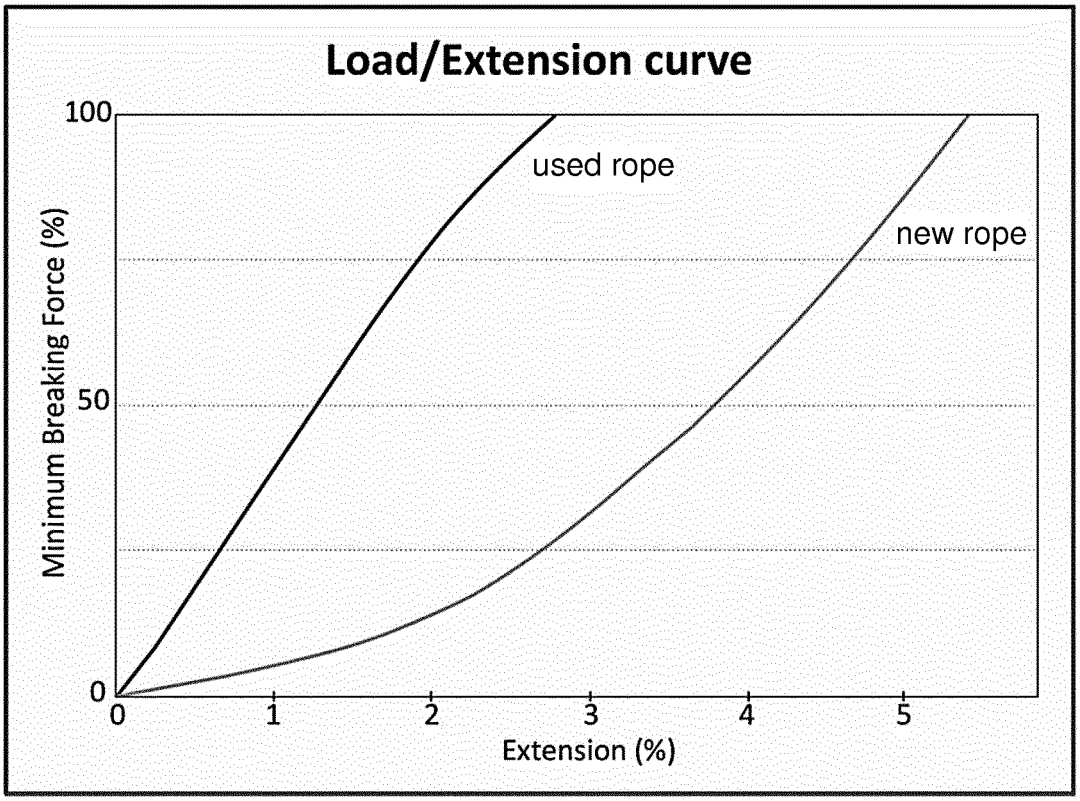
FIG. 6 illustrates a graph of an extension-to-break curve, according to an aspect of this disclosure.

The rope of the present invention typically has an extension-to-break of less than 10%, preferably less than 6%. FIG. 6 shows a typical extension-to-break curve of a particular rope according to the present invention.

The hoisting rope according to the present invention has a low weight over strength ratio. Typically, the rope weights 0.2 to 1 kg/m, without compromising its load-elongation and lead-bearing capacities as well as radial performance. For instance, a rope having a diameter of about 20 mm may weigh 0.2 to 0.3 kg/m.

The solid core of the present invention may comprise one or more monofilaments. A solid core comprising one monofilament is preferred. An appropriate rigidity of the solid core is typically imperative. That may be achieved with one monofilament. In embodiments with more than one monofilament, a laid or braid arrangement could be used, or the solid core may comprise a composite monofilament which is e.g. several individual elements (fibers or monofilaments) joint by a resin. Typically, the monofilament comprises a thermoplastic resin such as polyethylene, polypropylene, polyamide, polyester, thermoplastic polyurethane, polytetrafluoroethylene, other fluoropolymer or combinations thereof. The monofilaments may also be based on composite resins or thermoset resins. The resins used for the monofilaments may include fillers and/or additives to improve mechanical or specific material properties. Typical dimensions of the monofilament in the solid core are between 1 and 4 mm, preferably between 1.5 and 3.0 mm. The cross-sectional area of the solid core is less than 3%, preferably less than 2% more preferably between 1 and 2% based on the cross-sectional area of the entire rope construction. In one embodiment of the invention the cross-sectional area of the solid core is about 1.5% of the cross-sectional area of the entire rope construction. The solid core or one or more monofilaments used can also comprise hybrid monofilaments. These hybrid monofilaments are solid high strength monofilaments that are prepared by extruding a resin onto a high strength fiber or yarn. As such, the solid core of the present invention contributes to the load-bearing capabilities of the hoisting rope and may thus be regarded as more than a filler of the void in the first braided layer.

The load-bearing contribution may be used for non-destructive testing of the rope. To this end, in a preferred embodiment, the solid core is a functional solid core, preferably comprising a non-destructive testing (NDT) functionality. The solid core may for instance comprise an electrical conductive monofilament, which electrical conductivity or resistance can be used as and indication for the condition of the rope. Alternatively, the solid core may comprise an element that is treated to be detectible by a magnetic NDT device, such that a magnetic flux leakage or change in eddy current output can be detected. As such, the solid core preferably comprises cladded or metalized monofilaments adapted for non-destructive testing. In yet another embodiment, the solid core may comprises embedded optical fibers, suitable for example for non-destructive testing.

In a particular embodiment, the one or more monofilaments in the core are hybrid monofilaments comprising cladded or coated or otherwise treated high performance fibers adapted for non-destructive testing. These high-performance fibers can for instance be covered with a conductive resin over their entire length.

The ropes of the invention may be used for instance in fishing (trawl warp lines), mining (ropes on the winches), offshore oil and gas winning (rope on the winches), and the like.

The invention may be illustrated with the following examples.

Example 1

A hoisting rope having a diameter of 20.0 mm, consisting of a solid core of a monofilament comprising polyethylene (Tiptolene™ Thick Mono commercially available from Lankhorst Yarns), a first 12-strand plaited layer of Dyneema™ fibers and a second 12-strand plaited layer of Dyneema™ fibers, wherein the fibers are coated with synthetic polymers based on anionic polyurethane.

The rope was testing in a CBOS test with the test conditions as provided in table 1.

TABLE 1

CBOS test conditions

| Test conditions: | | |
|---|---|---|
| Sheave diameter: | 400 | bottom-bottom [mm] |
| Groove material: | RVS 304 | [—] |
| Groove diameter: | 1.06 | [x rope diameter] |
| Groove angle: | 30 | [°] |
| Cyclic frequency | 3.75 | [mcycles/min] |
| Single bend zone (max): | 29.9 | [x rope diameter] |
| Double bend zone: | 20 | [x rope diameter] |

Figure 7:
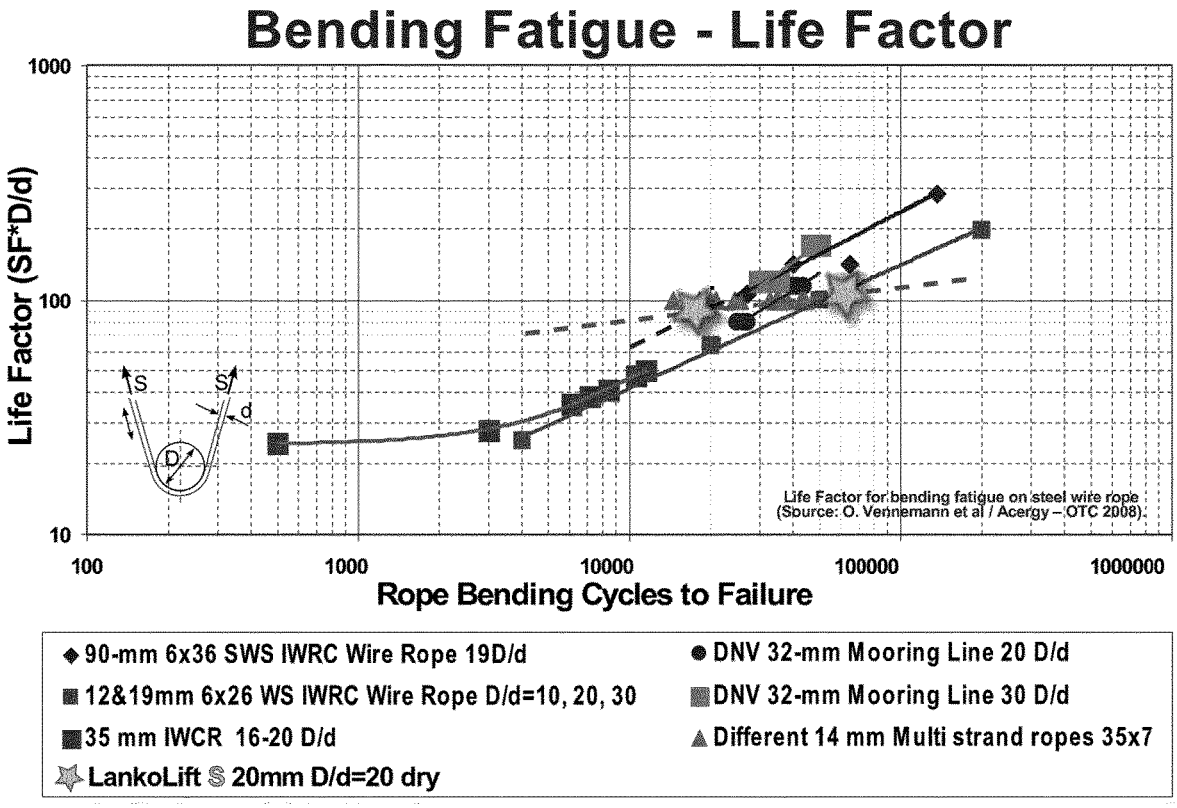
FIG. 7 illustrates a first graph of bending fatigue properties of a rope, according to an aspect of this disclosure.
Figure 8:
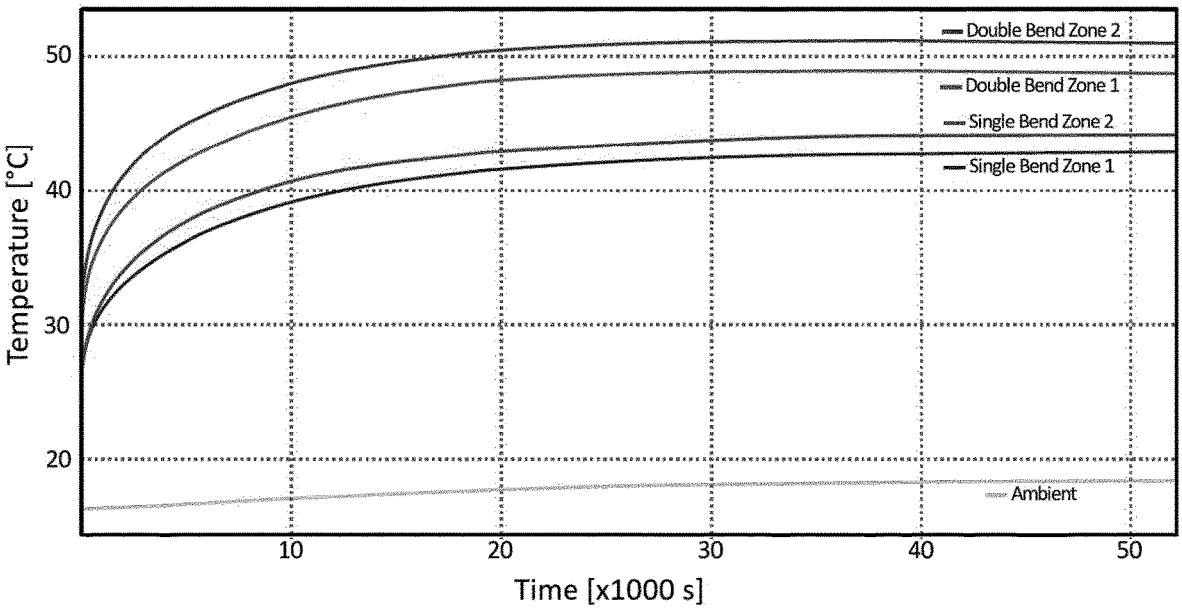
FIG. 8 illustrates a second graph of bending fatigue properties of a rope, according to an aspect of this disclosure.

The bending fatigue properties of the rope are provided in FIGS. 7 and 8, wherein the rope is labeled with LankoLift S 20 mm. FIG. 7 also shows comparative results of SWRs as determined by O. Vennemann et al., Acergy—OTC 2008. The rope of the present example shows excellent bending fatigue properties. FIG. 8 shows the temperature profiles of two samples (1 and 2) of the rope over time during the CBOS test.

Example 2

Hoisting ropes according to the rope in example 1 were prepared, having different diameters and properties as provided in table 2.

TABLE 2

| Rope diameter [mm] | Weight [kg/m] | MBL* (spliced) [mTon] | MBF** (spliced) [kN] |
|---|---|---|---|
| 16 | 0.175 | 21.26 | 208.49 |
| 18 | 0.224 | 28.32 | 277.72 |
| 20 | 0.269 | 37.54 | 368.14 |
| 24 | 0.403 | 47.5 | 465.82 |
| 26 | 0.468 | 54.65 | 535.93 |
| 28 | 0.535 | 63.37 | 621.45 |
| 32 | 0.667 | 77.04 | 755.5 |
| 36 | 0.831 | 91.32 | 895.54 |
| 38 | 0.899 | 98.45 | 965.46 |
| 40 | 0.971 | 105.21 | 1031.76 |

*MBL stands for the minimum breaking load in metric ton; one metric ton equals 1000 kg.
**MBF stands for the minimum breaking force as determined by ISO/DIS 2307.

The invention claimed is:

1. Synthetic hoisting rope comprising a solid core surrounded by a first braided load-bearing layer of a first set of strands that is surrounded by a second braided load-bearing layer of a second set of strands, wherein the first set and/or second set of strands comprise high performance fibers having a tenacity of at least 15 g/den, and wherein the second braided load-bearing layer provides at least 60% of a total load-bearing capacity of the rope, wherein the load-bearing capacity of each load-bearing layer is determined according to ISO 2307, and wherein a cross-sectional area of the solid core is less than 3%.

2. The synthetic hoisting rope according to claim 1, wherein the high performance fibers have a tenacity of at least 20 g/den.

3. The synthetic hoisting rope according to claim 1, further comprising at least one additional braided layer of an additional set of strands that surrounds the second braided layer.

4. The synthetic hoisting rope according to claim 1, wherein the set of strands independently comprise 3 to 32 strands.

5. The synthetic hoisting rope according to claim 1, wherein the braided layers are independently constructed by braiding a sub-set of twisted strands.

6. The synthetic hoisting rope according to claim 1, wherein the solid core comprises one or more monofilaments comprising a thermoplastic resin.

7. The synthetic hoisting rope according to claim 6, wherein the thermoplastic resin is a polyethylene, a polypropylene, a polyamide, a polyester, a thermoplastic polyurethane, a polytetrafluoroethylene, another fluoropolymer, or combinations thereof.

8. The synthetic hoisting rope according to claim 1, wherein the braided layers independently comprise yarns that comprise a protective coating.

9. The synthetic hoisting rope according to claim 8, wherein the coating surrounds the yarns.

10. The synthetic hoisting rope according to claim 9, wherein the coating surrounds individual fibers that form the yarns.

11. The synthetic hoisting rope according to claim 8, wherein the protective coating comprises polyurethane, silicon, or a combination thereof.

12. The synthetic hoisting rope according to claim 1, wherein the second braided load-bearing layer has a load-bearing capacity of at least 65%.

13. The synthetic hoisting rope according to claim 1, having a diameter between 0.5 to 10 cm.

14. The synthetic hoisting rope according to claim 1, wherein the cross-sectional area of the solid core is less than 2% based on a cross-sectional area of the synthetic hoisting rope.

15. The synthetic hoisting rope according to claim 1, having a minimum breaking force of at least 10 metric ton-force.

16. The synthetic hoisting rope according to claim 1, wherein the solid core is a functional solid core comprising a non-destructive testing functionality.

17. The synthetic hoisting rope according to claim 1, further comprising one or more successive braided layers that surrounds the second braided load-bearing layer.

18. A drum or crane comprising the synthetic hoisting rope according to claim 1.

19. Use of a hoisting rope according to claim 1.

20. Use of a hoisting rope according to claim 1 for hoisting load by a crane.

* * * * *